US005392582A

United States Patent [19]

Abukawa

[11] Patent Number: 5,392,582

[45] Date of Patent: Feb. 28, 1995

[54] MORTAR GROUTING TYPE CONNECTOR FOR REINFORCING BARS

[75] Inventor: Masahiro Abukawa, Koshigaya, Japan

[73] Assignee: Splice Sleeve Japan, Ltd., Tokyo, Japan

[21] Appl. No.: 77,627

[22] Filed: Jun. 17, 1993

[51] Int. Cl.[6] ..... E04C 3/30

[52] U.S. Cl. ..... 52/726.1; 52/711; 403/265

[58] Field of Search ..... 52/728, 704, 709, 711, 52/726.1, 295, 432, 439; 282/294, 297, 292; 403/268, 134, 305, 265

[56] References Cited

U.S. PATENT DOCUMENTS

| | | | |
|---|---|---|---|
| 1,689,281 | 10/1928 | Forssell . | |
| 3,540,763 | 11/1970 | Yee . | |
| 4,430,018 | 2/1984 | Fischer | 403/268 |
| 4,627,212 | 12/1986 | Yee . | |
| 4,666,188 | 5/1987 | Hockett | 285/294 X |
| 4,749,170 | 6/1988 | Ase . | |
| 4,919,560 | 4/1990 | Rutledge, Jr. et al. | 403/268 |
| 5,230,199 | 7/1993 | Yee | 403/305 X |

FOREIGN PATENT DOCUMENTS

| | | | |
|---|---|---|---|
| 61-233150 | 10/1986 | Japan . | |
| 63-7452 | 1/1988 | Japan . | |
| 3212537 | 9/1991 | Japan | 52/728 |
| 2192210 | 6/1988 | United Kingdom . | |
| 91/14839 | 10/1991 | WIPO . | |

*Primary Examiner*—Lanna Mai

*Attorney, Agent, or Firm*—Birch, Stewart, Kolasch & Birch

[57] ABSTRACT

A mortar grouting type connector for reinforcing bars having a grouting port and a discharging port disposed adjacent the ends thereof, a plurality of annular ridges provided on its internal surface and a stopper provided approximately at its mid-length portion, wherein a plurality of longitudinal flanges are provided which extend from around the stopper toward one end opening of the connector. The longitudinal flanges are provided to align the reinforcing bars within the connector and prevent the tip of the reinforcing bar inserted into the connector from being displaced.

10 Claims, 5 Drawing Sheets

MORTAR GROUTING TYPE CONNECTOR FOR REINFORCING BARS

BACKGROUND OF THE INVENTION

The present invention relates to a mortar grouting type connector for reinforcing bars, and more particularly to a connector wherein its shell body is provided on the internal surface of the connector with longitudinal flanges for alignment.

Among the different types of connectors for reinforcing bars there is a mortar grouting type connector for reinforcing bars, hereinafter referred to as a splice sleeve, which has been widely used in practice. Typical examples of such connectors are disclosed in U.S. Pat. Nos. 3,540,763 and 4,627,212 which are illustrated in FIG. 6.

The splice sleeve 1 is a longitudinally elongated hollow shell body, both end surfaces thereof being provided with openings and its internal surface being provided with a number of annular ridges 2. The interior of the splice sleeve has a stopper 3 (as disclosed in JP-A-61-233150) which is located approximately at the mid-length portion of the splice sleeve. The side wall has a grouting port 4-*a* located at a point close to one open end and a discharging port 4-*b* located at a point close to the other open end. End portions of a pair of reinforcing bars 6-*a* and 6-*b* are inserted into this splice sleeve in order to bring their tips into contact with the stopper ridge. Then fluid grouting mortar, hereinafter referred to as grout, is introduced into the splice sleeve. Abutt type connection between the pair of reinforcing bars will be accomplished when the grout has hardened.

The annular ridges 2 are provided so as to enhance the degree of engagement between the internal surface of the splice sleeve and the hardened grout and thereby to increase the interlocking effect of the reinforcing bars in the interior of the splice sleeve. To further enhance this action of increasing the interlocking effect, it is considered desirable that the configuration of the sleeve is such that the diameter of the opening becomes larger and larger from the splice sleeve opening toward the stopper ridge. This action of increasing the interlocking effect caused by the configuration of the sleeve with the diameter of the opening increasing inwardly is called the "wedging action." To obtain such a configuration of the sleeve, two embodiments are possible. One embodiment is an arrangement, as shown in FIG. 6(*a*), wherein the internal surface of a splice sleeve has a frusto-conical shape, i.e. a shape with the internal diameter progressively increasing from the end opening toward the stopper ridge, and the internal surface is provided thereon with annular ridges of equal height. Another embodiment is an arrangement, as shown in FIG. 6(*b*), wherein the internal surface of a splice sleeve has a constant diameter of cylindrical shape, i.e. a shape having the same internal diameter throughout its length. The splice sleeve is provided on the internal diameter or surface with annular ridges with their height progressively decreasing from the end opening toward the stopper ridge. The stopper 3 is provided so that the depth of insertion of a reinforcing bar into the splice sleeve can be easily adjusted to a predetermined depth. The grouting port 4-*a* is used as an inlet opening through which a grout is introduced into the splice sleeve, and the discharging port 4-*b* is used as an outlet opening for discharging air therethrough upon such grouting.

The splice sleeve exhibits an outstanding advantage over the other types of connectors for reinforcing bars, in particular, when utilized in connection between precast reinforced concrete pillars or wall members, hereinafter referred to as precast vertical members. This will be explained with reference to FIG. 7, which is a view of the upper and lower precast wall members connected together, taken from the members' header side.

A splice sleeve 1 is embedded in the lower end portion of the upper precast reinforced concrete wall member 7-*b* with its lower opening (i.e. the end opening adjacent to the grouting port) in the latter's lower end surface. The main reinforcing bar 8-*b* of the member is inserted through the upper opening (i.e. an end opening adjacent to the discharging port) in such a manner that the lower end of the bar comes into contact with the stopper 3. The upper end of the main reinforcing bar 8-*b* projects a predetermined distance upwardly beyond the upper end surface of the member. The lower precast reinforced concrete wall member 7-*a* is of the same structure, although the lower end portion thereof does not show another splice sleeve 1 embedded therein. The grouting port 4-*a* and the discharging port 4-*b* are connected to pipes for grouting 11-*a* and 11-*b*, respectively, with the other ends of the pipes opening to the external surface of the member. The upper precast reinforced concrete wall member is moved down from above the lower precast reinforced concrete wall member set in a vertical position in order to erect the upper member in such a manner that the upwardly projecting upper end of the main reinforcing bar 8-*a* of the lower member is received by the embedded splice sleeve 1. In the interspace between the upper and lower members, bedding mortar or a beam or floor member (not shown) is placed. Upon the completion of the erection, the upper end tip of the main reinforcing bar 8-*a* of the lower member is almost in contact with the stopper ridge. Grout (not shown) is then filled through the pipe 11-*a* into the embedded splice sleeve 1. In the case of connectors for reinforcing bars of types other than the splice sleeve, the longitudinal axes for the pair of reinforcing bars to be connected with each other must be strictly aligned with each other. In the erection of precast vertical members wherein a number of pairs of upper and lower reinforcing bars to be connected with each other between upper and lower members exist, it is impossible for all such bars to be erected in a strictly aligned manner. In contrast, in the case of the splice sleeve, connection is possible even when the pair of upper and lower reinforcing bars are slightly out of alignment as long as the bars can be received into the embedded splice sleeve through its openings. This represents the outstanding advantage of the splice sleeve over other types of connectors for reinforcing bars.

Precast vertical members of the structure as mentioned above may be manufactured as follows. As shown in FIG. 8 illustrating the manufacture of a precast reinforced concrete wall member, a reinforcing bar and sleeve combination with the splice sleeve 1 attached to one end of the reinforcing bar 8, which is to serve as the main reinforcing bar of the member, is arranged horizontally in a mold, and concrete is then placed therein to manufacture the precast reinforced concrete member. In the above-mentioned combination, the tip of the inserted reinforcing bar 8 is in contact with the stopper 3, and the opening through which to insert the reinforcing bar 8 (i.e. the opening adjacent to the discharging port 4-*b*) and the reinforcing bar 8 are secured together with a rubber plug 12. The end portion of the reinforcing bar 8 constituting one end of the combination passes through the side of the mold 14-*a* to be supported thereby. The splice sleeve 1 opening at the other end of the combination (i.e. the opening adjacent to the grouting port 4-*a*) is in contact with and is set to the side of the mold 14-*b* by means of a sleeve setter 13 as disclosed in U.S. Pat. No. 4,749,170. A special jig for setting the splice sleeve to the mold is located outside the side of the mold (details not shown). Polyvinylchloride pipes 11-*a* and 11-*b* are attached to the grouting and discharging ports, respectively, by insertion.

The above-mentioned method of manufacturing precast vertical members having the splice sleeve embedded in the lower end portion has the following problem. The combination of the splice sleeve and the reinforcing bar with the rubber plug 12 lacks rigidity because the plug 12 is made of rubber and is therefore soft. As a consequence, after the reinforcing bar 8 and splice sleeve 1 combination has been placed in the side mold, a phenomenon occurs wherein the combination, due to its own weight, is bent down at the point of the rubber plug securement. This phenomenon is referred to as "displacement of the reinforcing bar." Thus, although the longitudinal axes of the reinforcing bar 8 and the splice sleeve 1 should be in alignment, the displacement of the reinforcing bar 8 causes the axes to cross at an angle which is not desirable.

A splice sleeve provided with an anti-displacement ridge 15 designed to prevent such displacement of the reinforcing bar is disclosed in JP-A-63-7452. This anti-displacement ridge, as shown in FIG. 9, is a ring-formed ridge 15 with a central hole through which the reinforcing bar is to be inserted and is provided on the internal surface of the splice sleeve at a point slightly displaced from the mid-length position. The anti-displacement ridge of the type mentioned above, however, cannot be put to practical use because of the following problems. The first problem is that it hinders the smooth flow of the grout introduced into the splice sleeve from the grouting port to the discharging port. Thus, in order to achieve a sufficient anti-displacement effect, it is necessary for the difference of the diameters between the hole through which the reinforcing bar is to be inserted and the reinforcing bar to be small. In the case of ring-like ridges without notches as shown in FIG. 9(*a*), however, the cross-sectional area for the passage of the grout is small and also the cross section becomes suddenly throttled. As a result, the smooth flow of the grout is severely hindered, the resistance of the grouting is increased and also a large void is formed adjacent to the ridge. In the case of ring-like ridges with notches as shown in FIG. 9(*b*), the above-mentioned disadvantage is improved to some extent. However, the ratio of the ring-like ridge's area to the overall cross-sectional area is still high and also the ridge projects like a plate, so that the improvement is small with respect to the elimination of increasing the resistance to grouting and of void formation. The second problem is that the ring-like ridge is easily mistaken for the stopper ridge. Since, as mentioned above, the difference of the diameters is small between the hole in the ring-like ridge through which the reinforcing bar is to be inserted and the reinforcing bar, the tip of the reinforcing bar inserted from the splice sleeve opening does not often pass through the hole but collides with the ring-like ridge. The operator will easily be lead to misunderstand that the collision occurred with respect to the stopper ridge rather than the ring-like ridge. This results in a shorter depth of penetration of the reinforcing bar insertion than should be occurring, thereby decreasing, all the more, the tensile strength of the thus connected reinforcing bars.

The tips of the polyvinylchloride pipes attached by insertion to the grouting and discharging ports must not project into the interior of the splice sleeve. Such a projection will adversely affect the flow of the grout being introduced. However, an undesirable phenomenon often takes place if the polyvinylchloride pipe once set in place is moved, due to its contact with some outside influence in the course of manufacturing the member, into the interior of the splice sleeve with the tip thereof projecting into the interior of the sleeve.

SUMMARY OF THE INVENTION

Accordingly, the object of the present invention is to provide a splice sleeve having a structure which is capable of resolving the above-mentioned problems.

This object is achieved by providing a mortar grouting type connector which is provided with a plurality of longitudinal flanges which facilitate the alignment of the reinforcing bars as they are introduced into the splice sleeve of the connector.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
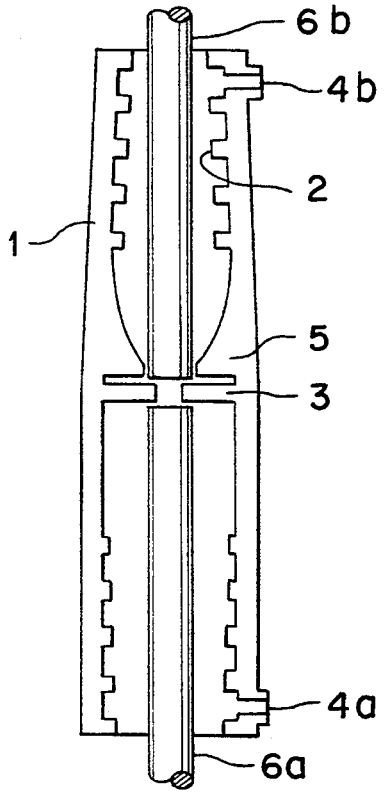
FIG. 1 is a longitudinal, sectional view of an embodiment of the splice sleeve of the present invention.
Figure 2:
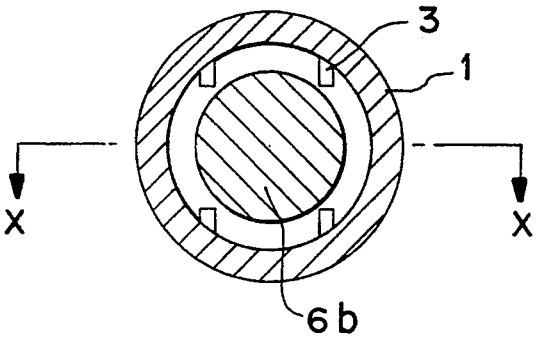
FIG. 2 is a cross-sectional view of the splice sleeve as shown in FIG. 1.

The splice sleeve 1 of the present invention as shown in FIGS. 1 and 2 is a mortar grouting type connector for reinforcing bars, comprising (a) a through hole grouting port 4-*a* provided in the side wall portion of a splice sleeve 1 adjacent to one open end; a through hole discharge port 4-*b* provided in the side wall portion of the splice sleeve adjacent to the other open end; a stopper 3 provided on the internal surface of the splice sleeve 1 approximately at the mid-length portion thereof; and a plurality of longitudinally spaced annular ridges 2 provided on the internal surface at each end opening and further inwardly to a depth corresponding to approximately half of the depth from each end opening to the stopper ridge;

(b) a plurality of longitudinal flanges 5 for alignment provided on the internal surface of the splice sleeve between the innermost annular ridge in the half portion of the splice sleeve and the stopper 3. The half portion constitutes that portion of the splice sleeve 1 extending from the end opening adjacent to the discharging port **4-*b* to the stopper 3, said longitudinal flanges extending from starting points adjacent to the stopper 3 to the end opening adjacent to the discharging port 4-*b*** and having the same direction of inward projection;

(c) said longitudinal flanges 5 for alignment being formed so that they are of maximal height at a point most adjacent to the stopper 3 and then progressively decrease in height as they approach the end opening adjacent to the discharging port **4-*b*;**

(d) the top edges of said flanges 5 at the starting points are so formed and positioned that they can hold in place the reinforcing bars **6-*b*** inserted into said half portion.

The splice sleeve of the type described above is hereinafter referred to as the splice sleeve according to the first embodiment of the present invention.

The splice sleeve according to the first embodiment of the present invention may be divided into two portions, i.e. the half portion adjacent to the discharging port and the half portion adjacent to the grouting port, meeting together at the stopper ridge. Both of the half portions may be simultaneously frusto-conical or cylindrical with a constant diameter in terms of shape as defined by the internal surface. Alternatively, one of the half portions may be frusto-conical and the other cylindrical with a constant diameter in shape. It is preferred for the half portion adjacent to the discharging port to have a frusto-conical shape and for the half portion adjacent to the grouting port to have a cylindrical shape with a constant diameter. The stopper ridge may be of any known shape and structure of different types. It is, however, desirable not to use a stopper ridge of such a shape and structure which would cause void formation upon grouting. From this viewpoint, it is preferred to use a ridge of the shape and structure as shown in the figures, i.e. a pillar-like ridge traversing the interior of the splice sleeve along one diameter with a cut-off portion in the center. Incidentally, a deformed bar is generally used as the main reinforcing bar for precast vertical members.

Figure 6A:
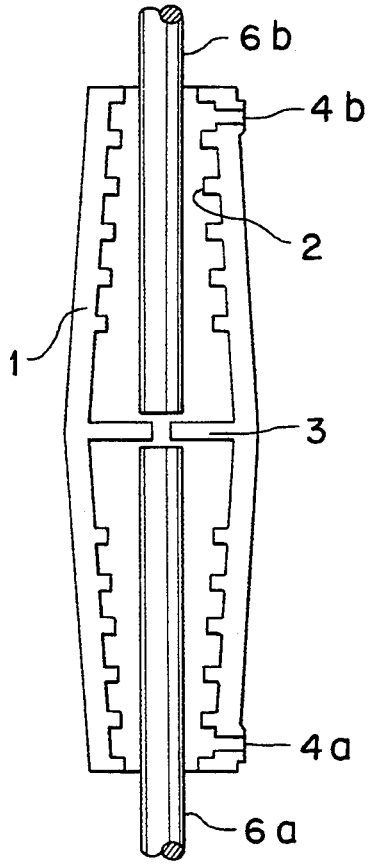
FIG. 6(a) PRIOR ART
FIGS. 6(*a*) and 6(*b*) are longitudinal, sectional views illustrative of prior art splice sleeves.
Figure 6B:
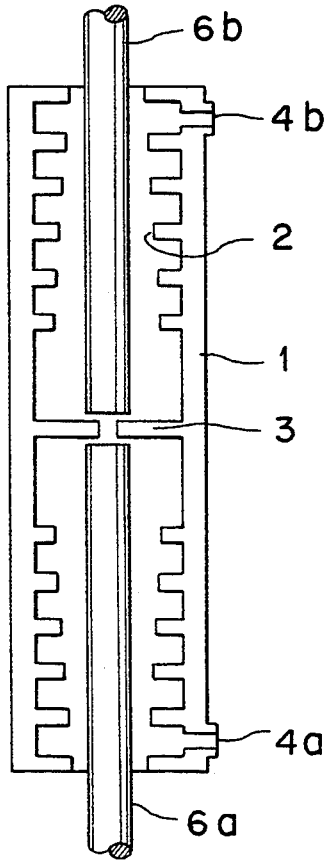
FIG. 6(b) PRIOR ART
Figure 7:
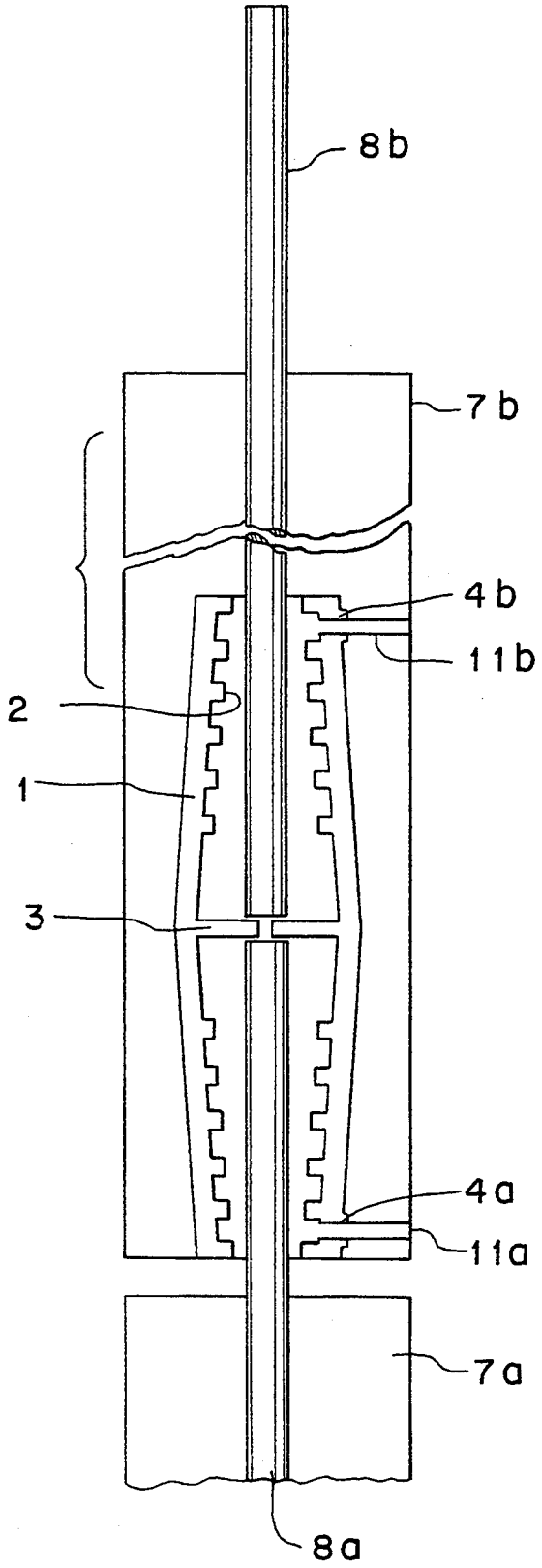
FIG. 7 is a longitudinal, sectional view illustrating the method of connection of a precast vertical member with a splice sleeve embedded therein.
Figure 8:
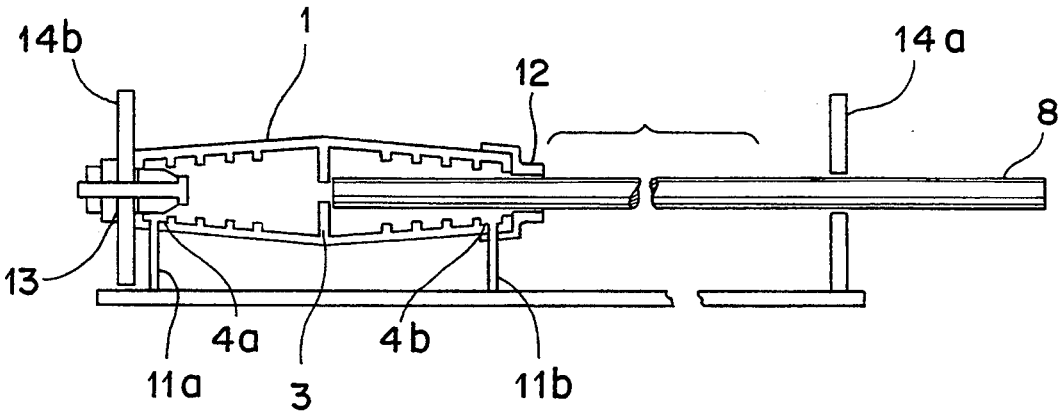
FIG. 8 is a longitudinal, sectional view illustrating the manufacturing of a precast vertical member with a splice sleeve embedded therein.

Annular ridges in the splice sleeve according to the first embodiment are ridges of equal height running along the internal surface of the splice sleeve vertically to the longitudinal axis of the splice sleeve. Preferably, these ridges are provided at each end opening and also further downwardly to a depth corresponding to one third-one half of the depth of each half portion of the splice sleeve, i.e. the depth from each end opening to the stopper ridge. A suitable number of annular ridges is 4–7, usually 5–6, per each half portion of the splice sleeve. The annular ridges are preferably arranged, as shown in FIG. 6, so that the diameter of the opening thereof increases toward the inner portion of the splice sleeve, preferably progressively. The angle of inclination of such increasing diameter of opening is 1–3 degrees to the longitudinal axis of the splice sleeve.

The difference (called clearance) between the diameter of the opening of the annular ridge located at the end opening of the splice sleeve, i.e. the diameter of the opening of the splice sleeve, and the diameter of a reinforcing bar (or the nominal diameter in the case of deformed bar) to be inserted through the end opening should be as small as possible, suitably around 5–10 mm. This is measured at the opening adjacent to the discharging port, i.e. at the end opening through which the main reinforcing bar for the upper vertical member has been inserted from the start of manufacturing the member. The clearance should be somewhat larger, suitably about 15–25 mm, at the end opening adjacent to the grouting port, i.e. at the end opening for receiving the main reinforcing bar for the lower vertical member, in order to enable the opening to receive the main reinforcing bar for the lower vertical member whose axis may be out of alignment.

The length of the splice sleeve according to the first embodiment will depend upon the required tensile strength of the connected reinforcing bars, the compressive strength of grout, etc. In general, however, where deformed bars are used, the 28-day compressive strength of grout is 500–800 $kg/cm^2$ and the desired tensile strength of the connected reinforcing bars is the maximal tensile strength of the reinforcing bar itself. The length of the splice sleeve is 13–17 times as long as the diameter of the reinforcing bar. Incidentally, the internal diameter of the grouting port and that of the discharging port are suitably 25 mm and 20 mm, respectively.

Figure 9A:
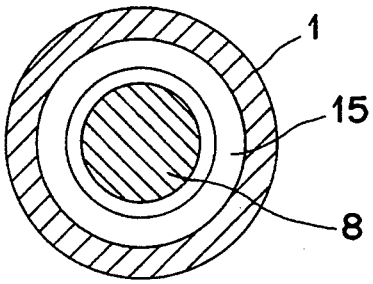
FIG. 9(a) PRIOR ART
FIGS. 9(*a*) and 9(*b*) are cross-sectional views illustrative of prior art anti-displacement ridges.
Figure 9B:
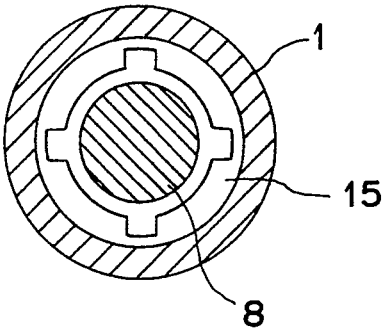
FIG. 9(b) PRIOR ART

The longitudinal flanges used for alignement in the splice sleeve according to the first embodiment neither hinder the smooth flow of grout nor cause void formation, since the ratio of their cross-sectional areas to the overall cross-sectional area of the splice sleeve is much smaller than in the case of known ring-like ridges for alignment as shown in FIG. 9. Furthermore, the top edges gradually increase in height from the end opening to the inner portion of the splice sleeve. Consequently the tip of the inserted reinforcing bar is guided, while contacting the top edge, so that its axis aligns itself with the longitudinal axis of the splice sleeve. Then it passes through the opening space defined by the group of the highest top edges of the longitudinal flanges for alignment into abutting engagement with the stopper ridge. The opening space exerts its action of alignment on the tip of the reinforcing bar by means of the top edges holding the bar while slightly touching the same. Accordingly, the above-mentioned first and second problems with ring-like ridges for alignment can be resolved.

As shown in FIG. 2, the direction of projection is the same for a plurality of longitudinal flanges for alignment in the splice sleeve according to the first embodiment. Thus, the manufacture of shell bodies having a complex internal structure like splice sleeves could be usually carried out by casting. In this method, a pair of mold halves corresponding to a pair of half bodies obtainable by a longitudinal section of the shell body with a plane including one diameter (plane X—X as shown in FIG. 2) are put together to form a shell body mold. After injection of a molten metal, the mold halves are separated to take out the resultant casting product. The above-mentioned plane X—X corresponds to a plane on which the opposed faces of the mold halves are to be put together, and the direction of separation of the mold halves is perpendicular to the plane. If the direction of projection of longitudinal flanges 5 for alignment is not perpendicular to the plane X—X but inclined thereto, separation of the mold halves becomes impossible. It is therefore essential for all longitudinal flanges for alignment to have the same direction of projection, i.e. the same direction as the direction of separation of mold halves being perpendicular to the plane on which the opposed faces of mold halves are to be put together.

Figure 3:
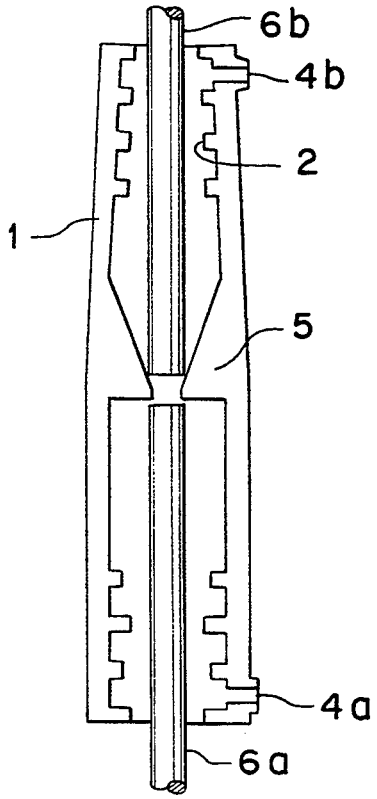
FIG. 3 is a longitudinal, sectional view of another embodiment of the splice sleeve of the present invention.
Figure 4:
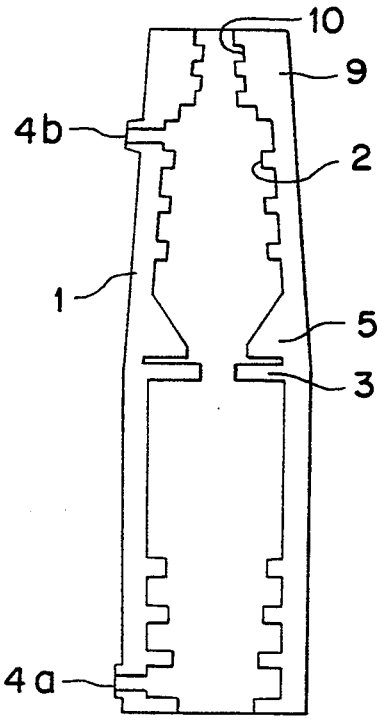
FIG. 4 is a longitudinal, sectional view of still another embodiment of the splice sleeve of the present invention.
Figure 5:
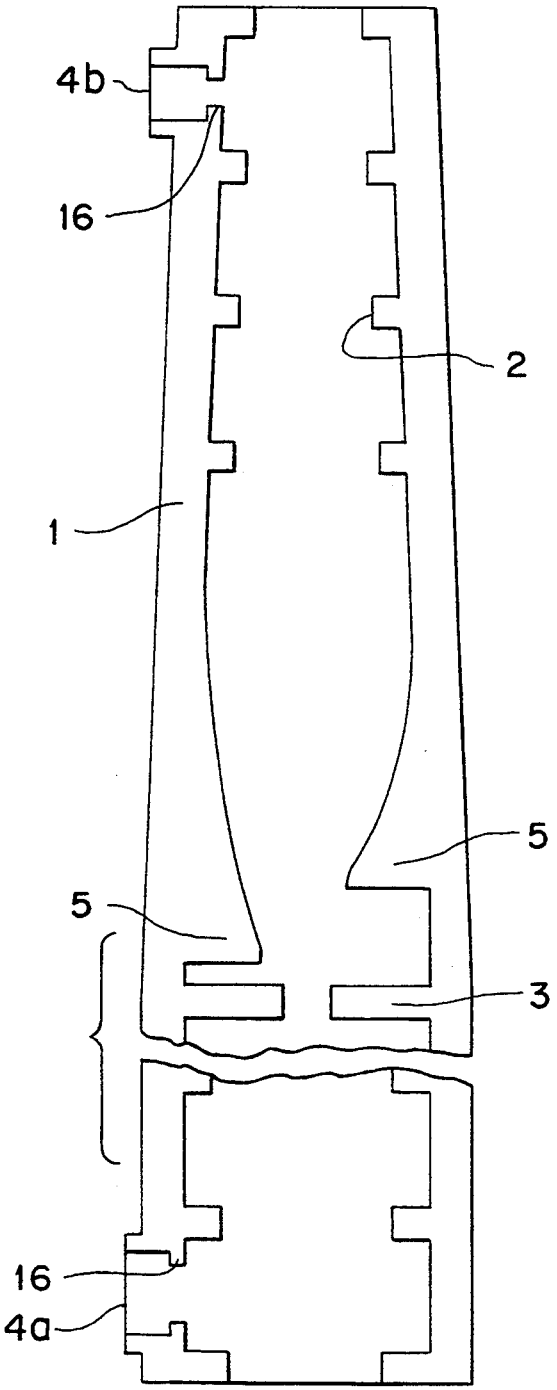
FIG. 5 is a longitudinal, sectional view of a further embodiment of the splice sleeve of the present invention.

The longitudinal flanges for alignment progressively increase in height as they extend toward the inner portion of the splice sleeve. The mode of such progressive increase in height may be linear as shown in FIGS. 3 and 4 or concaved toward the internal surface of the splice sleeve as shown in FIGS. 1 and 5. These flanges must be arranged on both sides of the plane X—X but the number thereof may not be the same on both sides. It is preferred to arrange them in symmetry with respect to both the plane X—X and a plane perpendicular thereto. Striations of a set of two longitudinal flanges for alignment present in the half portion of one of the halves obtained by a longitudinal section of the splice sleeve, extending from the inner portion to the end opening of the splice sleeve, may be parallel to each other as well as to the longitudinal axis. From the standpoint of the above mentioned guidance of the inserted reinforcing bar, however, it is preferred for them to spread outwardly from the inner portion to the end opening with an inclination to each other. The depths from the end opening of the half portion of the splice sleeve, adjacent to the discharging port, to the starting points of the longitudinal flanges for alignment may be all equal as shown in FIG. 1 or may vary as in FIG. 5.

Another embodiment of the splice sleeve of the present invention, which is an improvement of the splice sleeve according to the first embodiment, will now be explained with reference to FIG. 3. This splice sleeve is a mortar grouting type connector for reinforcing bars, comprising the splice sleeve according to the first embodiment, wherein the starting points of the longitudinal flanges for alignment are located where the stopper ridge is normally provided. The opening space defined by the highest top edges of the longitudinal flanges for alignment at their starting points is formed and positioned so that it does not permit the inserted reinforcing bars 6-*a* and 6-*b* to pass therethrough. No stopper ridge is provided. The splice sleeve of the type described above is hereinafter referred to as the splice sleeve according to the second embodiment of the present invention.

In the splice sleeve according to the second embodiment, a reinforcing bar inserted from the end opening adjacent to the discharging port is brought into contact with the top edges on its way to the highest points of the longitudinal flanges 5 for alignment. At the points of contact of the longitudinal flanges the action of alignment of the reinforcing bars is performed. Thus, the longitudinal flanges for alignment have two functions, i.e. the function of alignment and the function of a stopper. The splice sleeve of this type is advantageous over the splice sleeve according to the first embodiment in that the manufacturing can be rendered simpler. Furthermore, it is also advantageous in that the possibility of void formation upon grouting is greatly reduced due to the absence of a stopper ridge.

Still another embodiment of the splice sleeve of the present invention, which is a further improvement of the splice sleeve according to the first or second embodiment with respect to the arrangement of the annular ridges, will now be explained with reference to FIG. 3. This splice sleeve is a mortar grouting type connector for reinforcing bars comprising the splice sleeve according to the first or second embodiment, wherein the annular ridges 2 comprise high and low ridges arranged alternately in the splice sleeve half portion having the cylindrical shape with a constant diameter (the half portion on the side of the grouting port in FIG. 3). One of the higher ridges is located at the end opening of the half portion and the higher and lower ridges are each approximately the same height. The splice sleeve of the type described above is hereinafter referred to as the splice sleeve according to the third embodiment.

In the splice sleeve according to the third embodiment, the slope formed by the neighboring higher and lower annular ridges is suitably at an angle of 1–3 degrees to the longitudinal axis of the splice sleeve, and two to four pairs of the higher and the lower annular ridge will suffice.

As referred to in the description of the conventional splice sleeve shown in FIG. 6, it is preferred for the annular ridges to be arranged and structured so that their diameter of opening becomes larger and larger toward the inner portion of the splice sleeve in order for the so-called wedging action to be obtained. In this case, the greater the slope of the progressive increase in diameter of opening is or the longer the distance between the innermost annular ridge and the annular ridge at the end opening of the splice sleeve is, the bigger the difference in diameter of opening between the two ridges. The diameter of the opening of the annular ridge located at the end opening of the sleeve is dependent on the diameter of the reinforcing bar to be inserted into the splice sleeve. It follows that the arrangement and structure as mentioned above maximizes the difference between the maximum diameter of the splice sleeve and the diameter of the inserted reinforcing bar. The problem associated with the arrangement and structure of the type described above is that the maximum diameter of the splice sleeve should be as small as possible. In the splice sleeve according to the third embodiment wherein the higher and lower ridges are arranged in an alternate manner, the difference between the diameter of the opening of the splice sleeve and the maximum diameter of the splice sleeve is reduced to the difference in height between one pair of the higher and one pair of the lower ridges. Therefore, the difference is far smaller than in the case of a conventional arrangement and structure, notwithstanding the fact that the distance is long between the annular ridge at the end opening and at the innermost portion of the splice sleeve. Accordingly, this splice sleeve has the advantage that the maximum diameter of the splice sleeve can be rendered smaller than in the case of a conventional structure. Nevertheless, an equivalent wedging action is achieved.

Another embodiment of the splice sleeve of the present invention with the open end portion having a special structure will now be explained with reference to FIG. 4. This embodiment is a mortar grouting type connector for reinforcing bars according to the first, second or third embodiment, wherein a helical groove portion 9 defines the longitudinal through hole in the splice sleeve end portion adjacent to the discharging port. The internal surface of said hole is engraved with a helical groove 10 with the number of helical cycles being one or two. The splice sleeve of the type described above is hereinafter referred to as the splice sleeve according to the fourth embodiment.

Among different types of deformed bars which are generally used as the main reinforcing bar for precast members are helical rib patterned deformed bars provided on the surface thereof with an outwardly projecting helical rib. When a helical groove portion is provided in the splice sleeve end portion and its internal surface is provided with a helical groove which can be screwably engaged with the helical rib of the helical rib patterned deformed bar to be used, a reinforcing bar and sleeve combination as mentioned above can be formed by screwing the helical rib patterned deformed bar into the helical groove portion to insert the same into the splice sleeve. The resultant combination between the reinforcing bar and the sleeve is much stronger than with rubber plugs as described above. The "displacement of the reinforcing bar," thus, does not take place. However, the problem is that helix properties of helical ribs may more or less vary depending upon the source of supply of the helical rib patterned deformed bar, and thus a splice sleeve, which fits a helical rib patterned deformed bar from one source of supply may not fit a helical rib patterned deformed bar from another source of supply.

The helix properties of the helical groove in the splice sleeve according to the fourth embodiment are set at the average helix properties of helical rib patterned deformed bars commercially available from different sources of supply. Because of the number of cycles being one or two, helical rib patterned reinforcing bars from most sources of supply can screwably engage with the helical groove in the helical groove portion of the splice sleeve, and can therefore, be inserted into the splice sleeve. This screwable engagement is more moderate than in the case in which the helix properties of both are identical with each other, but the combination between the reinforcing bar and the splice sleeve is stronger than with rubber plugs. Helical grooves with less than one cycle are not practical because the above mentioned combination becomes weaker. Furthermore, those with more than two cycles are not desirable because the range of the counterparting helical rib's helix properties within which its moderate engagement is permitted with the helical groove, sharply narrows. The splice sleeve according to the fourth embodiment, although conditioned to use helical rib patterned deformed bars as a reinforcing bar, has the advantage that the use of rubber plugs may be omitted in forming reinforcing bar and sleeve combinations, and also that helical rib patterned deformed bars from a wide range of sources of supply are usable. The use of rubber plugs is disadvantageous not only because their strength of combination is low, but also because the work of their attachment is cumbersome.

Still another embodiment of the splice sleeve of the present invention is an improvement with respect to the grouting and the discharging port of the splice sleeve according to any one of the first-fourth embodiments, which will now be explained with reference to FIG. 5. This embodiment is a grouting type connector for reinforcing bars according to any one of the first-fourth embodiments, wherein collision ridges 16 are provided on the internal surfaces of the grouting port 4-*a* and the discharging port 4-*b*. The splice sleeve of the type described is hereinafter referred to as the splice sleeve according to the fifth embodiment.

As mentioned above, in manufacturing precast vertical members with the splice sleeve embedded therein, pipes for grouting (normally polyvinylchloride pipes) are attached by insertion into the grouting and discharging ports (hereinafter referred collectively to as the lateral hole), wherein the tips of the pipes must not project into the interior of the splice sleeve. The collision ridges in the splice sleeve according to the fifth embodiment act as a stopper. Thus, the tips of the pipes for grouting, when inserted into the splice sleeve, will collide with these ridges so that they cannot proceed any further beyond.

The position of the collision ridges is adjacent to the inside openings of the lateral hole, preferably flush with the internal surface of the splice sleeve. The collision ridges may be in any different form suitable as a stopper, e.g. an annular ridge, a notched annular ridge or a plurality of independent ridges. Furthermore, the height of the collision ridge should be of the order of the wall thickness of the pipe for grouting to be inserted into the lateral hole.

The external diameter of the pipe for grouting to be inserted into the lateral hole is rendered somewhat smaller than the internal diameter of the lateral hole, in order to ensure smooth insertion. This, however, gives rise to some post-insertion allowance between the lateral hole and the pipe, so that the work of taping with adhesive tape becomes necessary to ensure firm fixation between them as well as sealing. When a ridge or bulge is provided on the internal surface of the lateral hole at an appropriate position between the collision ridge and the outside opening of the lateral hole with its diameter of opening being somewhat smaller than the external diameter of the pipe for grouting, the pipe will be pressed upon its passage therethrough to be firmly held in the lateral hole. As a result, the taping work as mentioned above can advantageously be omitted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A mortar, grouting connector for reinforcing bars comprising, a splice sleeve having side wall portions with internal surfaces and open end portions at each end of said splice sleeve, an inlet grouting port provided in a side wall portion adjacent to one open end portion, a discharge port provided in a side wall portion adjacent to the other open end portion, a plurality of longitudinally spaced annular ridges disposed on the internal surfaces of the side wall portions and extending from each open end portion a distance toward the middle portion of the splice sleeve, and a plurality of opposing longitudinal flanges extending from the internal surfaces of the splice sleeve between the annular ridges to the mid-portion of the splice sleeve, said opposing longitudinal flanges extending toward each other to form a centrally disposed aperture wherein said longitudinal flanges project inwardly with a maximum height of projection being at a point near said middle portion of said splice sleeve and decreasing in height as the longitudinal flanges approach the annular ridges nearest said discharge port.

2. The mortar grouting type connector as claimed in claim 1, wherein one-half of the splice sleeve has a cylindrical shape with a constant diameter, said one-half portion containing high and low annular ridges which alternately extend toward the center of the splice sleeve, one of the higher ridges being located at the open end portion of the half portion, the higher and the lower ridges being substantially the same height, respectively.

3. The mortar grouting type connector as claimed in claim 1, wherein the internal surface of the open end portion of the splice sleeves, adjacent to the discharge port, is provided with a helical groove.

4. The mortar grouting type connector of claim 1 wherein, the helical groove has 1 to 2 cycles.

5. A mortar, grouting-type connector for reinforcing bars which comprises, a splice sleeve having side wall portions with internal surfaces and open end portions, an inlet grouting port provided in a side wall portion adjacent to one open end portion, a discharge port provided in a side wall portion adjacent to the other open end portion, a stopper means extending from the internal surfaces of the side walls of the splice sleeve at about a mid-length thereof, a plurality of longitudinally spaced annular ridges disposed on the internal surfaces of the side wall portions and extending from each open end portion a distance toward said stopper means, and a plurality of opposing longitudinal flanges extending from the internal surface of the splice sleeve between the annular ridges and the stopper means, said opposing longitudinal flanges extending toward each other to form a centrally disposed aperture wherein said longitudinal flanges project inwardly with a maximum height of projection being at a point near said stopper means and decreasing in height as the longitudinal flanges approach the annular ridges nearest said discharge port.

6. The mortar grouting type connector as claimed in claim 5, wherein the annular ridges extend inwardly on the internal surface for a distance corresponding to approximately one-half of the distance from each open end portion to the stopper means, and wherein top edges of the longitudinal flanges are so formed and positioned so that they can hold in place the reinforcing bars introduced into the half portion of the splice sleeve which extends from the open end portion disposed adjacent to the discharge port to the stopper means.

7. The mortar grouting type connector as claimed in claims 5 or 6, wherein one-half of the splice sleeve has a cylindrical shape with a constant diameter, said one-half portion containing high and low annular ridges which alternately extend toward the center of the splice sleeve, one of the higher ridges being located at the open end portion of the half portion, the higher and the lower ridges being substantially the same height, respectively.

8. The mortar grouting type connector as claimed in claims 5 or 6, wherein the internal surface of the open end portion of the splice sleeves, adjacent to the discharge port, is provided with a helical groove.

9. The mortar grouting type connector of claim 8 wherein the helical groove has 1 to 2 cycles.

10. The mortar grouting type connector as claimed in claim 5, wherein collision ridges are provided on the internal surfaces of the grouting port and the discharge port.

* * * * *